US005897038A

United States Patent [19]

Myers

[11] Patent Number: 5,897,038

[45] Date of Patent: Apr. 27, 1999

[54] LIQUID DISPENSING WAGON

[76] Inventor: Jeff D. Myers, 7525 N. Shadow Mountain Rd., Paradise Valley, Ariz. 85253

[21] Appl. No.: 08/863,283

[22] Filed: May 27, 1997

[51] Int. Cl.[6] ..... A01C 35/00; A01G 25/09; A63H 17/00; F04F 10/00

[52] U.S. Cl. ..... 222/608; 222/628; 239/172; 137/125; 446/78; 446/451; 446/483

[58] Field of Search ..... 446/78, 451, 483; 222/608, 628; 239/172; 137/125

[56] References Cited

U.S. PATENT DOCUMENTS

| | | | |
|---|---|---|---|
| 1,081,817 | 12/1913 | Deming | 222/628 |
| 1,616,997 | 2/1927 | Taylor | 222/628 |
| 1,800,587 | 4/1931 | Appleby | 446/451 |
| 1,866,106 | 7/1932 | Herlihy | 222/628 |
| 2,191,184 | 2/1940 | Voorheis | 446/451 |
| 5,295,890 | 3/1994 | Myers | 446/176 |

*Primary Examiner*—Andres Kashnikow
*Assistant Examiner*—Keats Quinalty
*Attorney, Agent, or Firm*—Warren F. B. Lindsley

[57] ABSTRACT

A utility wagon or toy version thereof for containing a source of dispensable liquid and having a pump mounted in the wagon for pressurizing the source of liquid by actuating a reciprocally movable handle, and a wand connected to the source of liquid for selectively dispensing the liquid under pressure.

1 Claim, 2 Drawing Sheets

FIG. 3
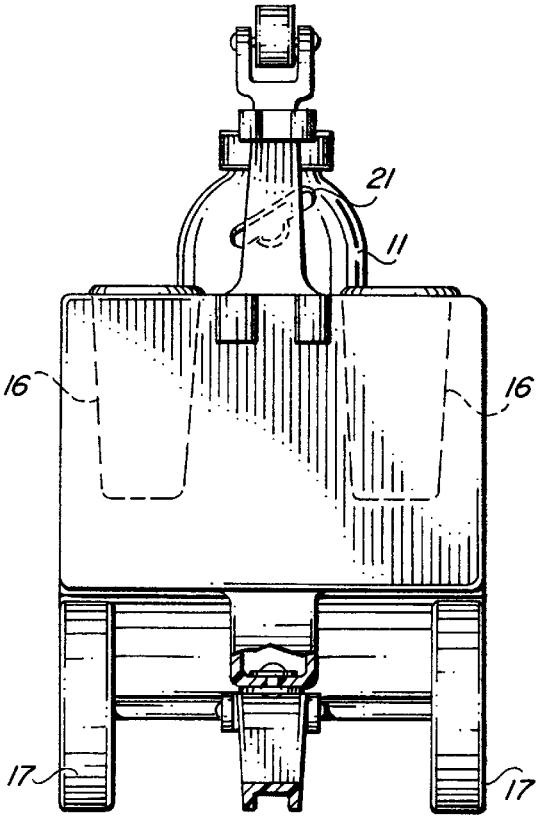
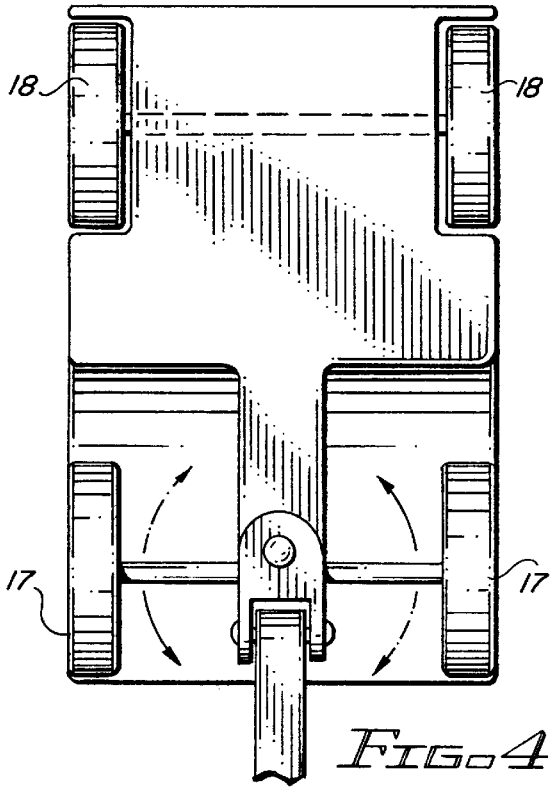
FIG. 4
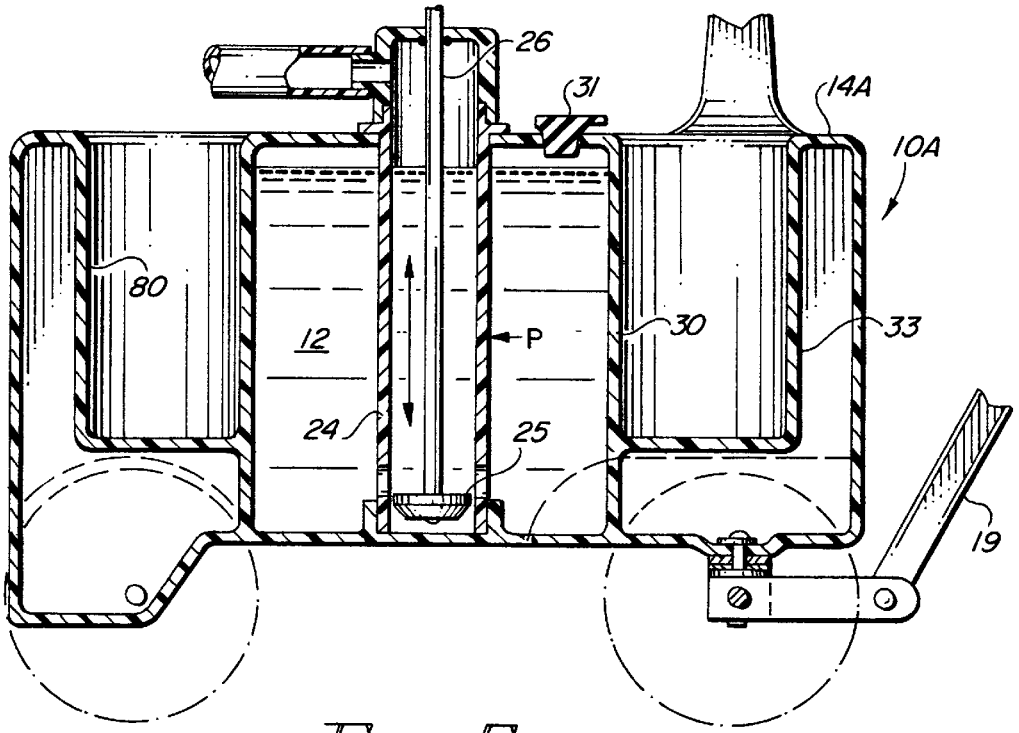
FIG. 5

LIQUID DISPENSING WAGON

BACKGROUND OF THE INVENTION

This invention relates to a water wagon which may be used in full scale for gardening purposes or in reduced scale as a toy and more particularly to a wagon having contained thereon a pressurizable water dispensing means that is controlled by a water dispensing wand and nozzle.

DESCRIPTION OF THE PRIOR ART

Gardening tools and toys from the earliest days have been a necessary constituent of human health and development.

Many toys are model machines of known equipment and particularly objects such as wagons, cars, trucks and various military vehicles. Some of the wagon vehicles have been known to dispense water but toy wagons which contain a reservoir of water that is pressurized and selectively dispensed through a wand or nozzle are not known.

U.S. Pat. No. 5,295,890 discloses an apparatus for generating a stream or burst of water through a vehicle mounted water cannon by a remote transmitter which generates signals for receipt by a receiver mounted on the vehicle for controlling the stream or burst of water.

SUMMARY OF THE INVENTION

In accordance with the invention claimed, a new water dispensing cart or wagon is provided which has contained thereon a water pressurizing tank having connected thereto a water dispensing wand and nozzle. The water pressurizing means comprises a pump reciprocally mounted in a tank which is pressurized by a handle pivotally mounted on the wagon.

It is, therefore, an object of this invention to provide a new and improved water wagon for gardening purposes or a toy for child entertainment purposes.

Another object of this invention is to provide a new and improved cart or wagon that utilizes a self-contained water source that is pressurizable by youngsters and/or adults using the wagon for gardening or entertainment purposes.

A further object of this invention is to provide a toy wagon having a water containing bottle that has therein a pressurizing pump that is operable by a youngster and/or adult playing with or using the wagon for dispensing water or other suitable liquid.

A still further object of this invention is to provide a pullable wagon that contains apertures in its cover for housing a cup for carrying gardening tools.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which:

FIG. 3 is a front view of the wagon shown in FIG. 1;

FIG. 4 is a bottom view of the wagon shown in FIG. 1; and

FIG. 5 is a cross sectional view of a modification of FIG. 1 showing a uni-body construction and more detail of the pressurizing pump shown in FIGS. 1 and 2.

DESCRIPTION OF THE PREFERRED EMBODIMENT

Figure 1:
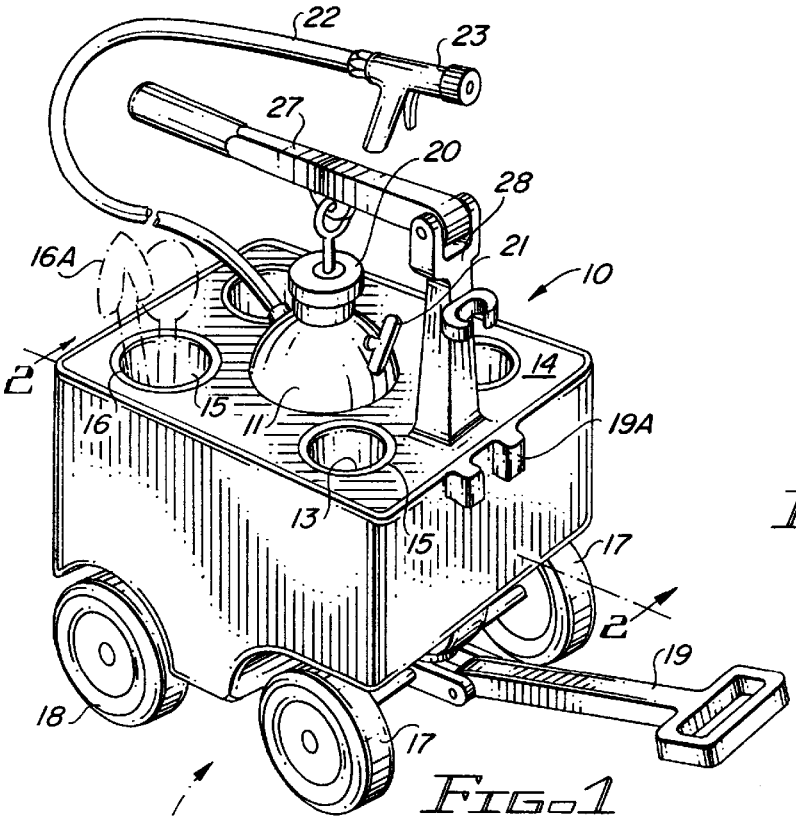
FIG. 1 is a perspective view of a liquid dispensing wagon embodying one embodiment of the present invention.
Figure 2A:
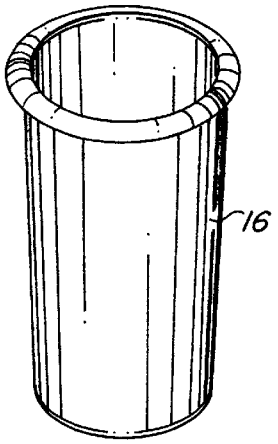
FIG. 2A is a perspective view of a cup for mounting in a suitable opening in the top of the cover of the wagon shown in FIG. 1.
Figure 2B:
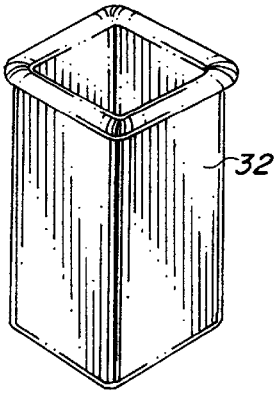
FIG. 2B is a perspective view of a modification of the cup shown in FIG. 2A for mounting in a suitable opening in the top of the wagon as shown in FIG. 5.
Figure 2:
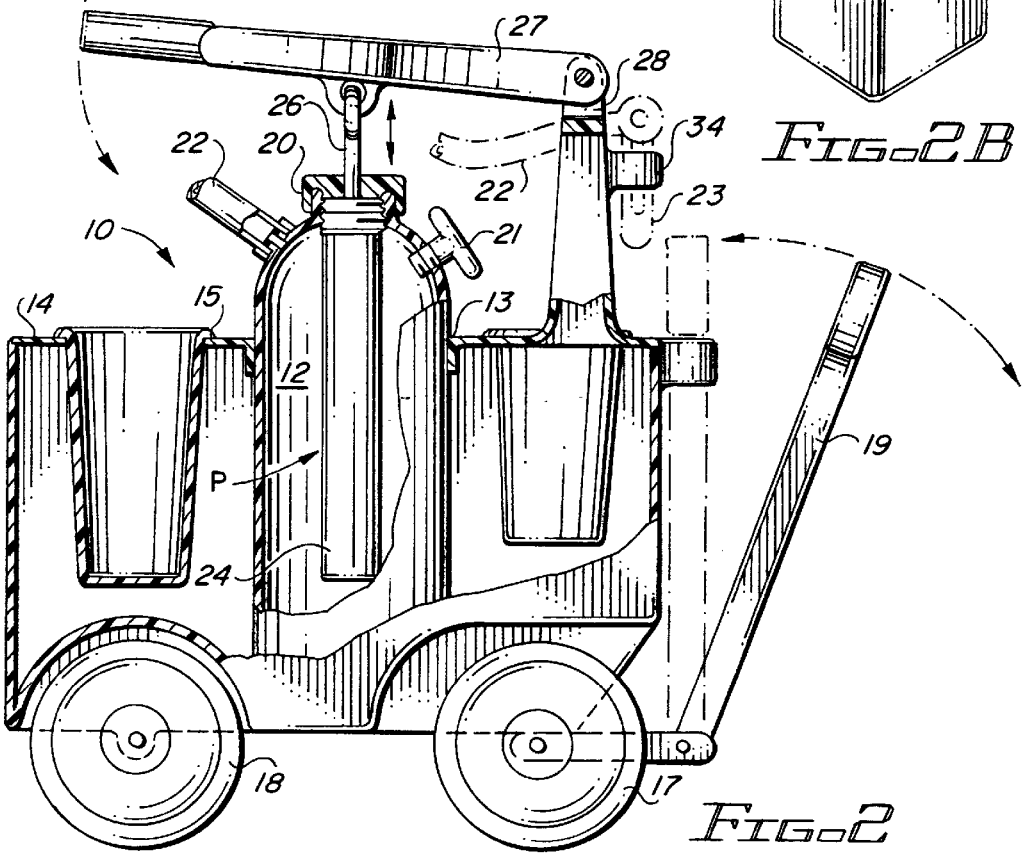
FIG. 2 is a cross sectional view of FIG. 1 taken along the line 2—2.

Referring more particularly to the drawings by characters of reference, FIGS. 1–4 disclose a cart or wagon 10 containing a pressurizable tank, reservoir or bottle 11 that is vertically mounted in the wagon in either a detachable or fixedly mounted manner. The bottle may contain any suitable liquid such as water 12 with the bottle snugly fitted into a suitable opening 13 in a cover 14 of the wagon. Other openings 15 formed in cover 14 of wagon 10 are made to receive paper or plastic cups 16 which are available for storing spoons 16A, shovels or other similar articles.

It should be noted that wagon 10 may be used as a gardening tool or watering apparatus or on a reduced scale as a toy.

Wagon 10 is axially mounted on front wheels 17 and back wheels 18 with the front wheels 17 being pivotally or swivelly mounted for steering purposes and movable by an operator, in the usual manner by pivotal movement of handle 19 which handle when vertically positioned may be held by a clamp 19A in that position.

Reservoir or bottle 11 is vertically mounted in wagon 10 and opened and closed at its top by a screw cap 20. A hand operated pressure release valve 21 is mounted near the top of the bottle 11. A wand 22 controlled by a liquid dispensing nozzle 23 is connected to the interior of bottle 11 as shown. Wand 22 and nozzle 23 may be replaced by another liquid dispensing means.

Bottle 11 has a pump P mounted longitudinally therein which pump comprises a cylinder 24, piston 25 and piston rod 26, as shown in FIG. 5, for pressurizing bottle 11. Piston 25 and piston rod 26 are axially movable in cylinder 24 by means of a handle 27 which is connected to piston rod 26 for axial movement thereof. Handle 27 is pivotally connected to wagon 10 through a mounting means 28 connected to cover 14. Bottle 11 may also be molded into one piece with the body of the wagon thereby being uni-body in construction or separately attached to the body of the wagon in a fixed or detachable manner.

Thus, when bottle 11 is at least partially filled with a liquid such as water and handle 27 is pivotally movable about mounting means 28 pressure will be built up in bottle 11 thereby permitting liquid in bottle 11 to be dispensed from the bottle through wand 22 and nozzle 23 into cup 15 or other gardening implements as well as over any garden plant or garden area.

FIG. 5 discloses a modification of wagon 10 wherein wagon 10A has a fixedly mounted container 30 mounted or molded therein for holding liquid such as, for example, water 12 or liquid fertilizer with a suitable pump P being mounted therein. Valve 21 of FIG. 1 is replaced by a rubber insert or plug 31 and wand 22 is connected to cylinder 24 of pump P. The cups 32 are a rectangular configuration and fit into rectangular openings in cover 14A of the wagon.

All other similar parts of wagon 10 are given the same references as used in FIG. 1.

It should be noted that nozzle 23 may be attached to wagon 10 by means of clamp 34.

Although only certain embodiments of the invention have been illustrated and described, it will be apparent to those skilled in the art that various changes and modifications may be made therein without departing from the spirit of the invention or from the scope of the appended claims.

What is claimed is:

1. An apparatus for holding and dispensing liquid comprising a four wheeled wagon having front and back pairs of wheels mounted on the bottom of a cargo container with the front pair of wheels being axle mounted with the axle being fixedly attached to the bottom of the cargo container by a swivel joint;

a liquid container mounted in said cargo container;

a pump mounted in said liquid container and comprising a piston means having a piston rod extending outwardly thereof;

a pivotally mounted handle mounted on said wagon and attached to said piston rod for movement of said piston means for pressurizing the liquid in said liquid container;

a liquid dispensing wand connected at one end to said liquid container and having a nozzle mounted at its other end for dispensing liquid under pressure from said liquid container; and a cover for said cargo container;

said cover comprising at least a pair of apertures one for receiving said liquid container and the other for receiving at least one cup.

* * * * *